United States Patent [19]

Egert et al.

[11] 4,045,082

[45] Aug. 30, 1977

[54] SEAT HAVING BACK REST WITH DIFFERENT PIVOTS FOR TILTING AND FOR FOLDING LEVEL

[75] Inventors: Allen C. Egert, Davenport, Iowa; L. John Koutsky, Milan; Dale R. Ropp, Aledo, all of Ill.

[73] Assignee: Sears Manufacturing Co., Davenport, Iowa

[21] Appl. No.: 725,398

[22] Filed: Sept. 22, 1976

[51] Int. Cl.[2] ..... A47C 1/025

[52] U.S. Cl. ..... 297/357; 297/379

[58] Field of Search ..... 297/357, 378, 379, 354, 297/355, 366–369, 124, 125

[56] References Cited

U.S. PATENT DOCUMENTS

| | | | |
|---|---|---|---|
| 1,652,165 | 12/1927 | Craven | 297/357 X |
| 3,235,308 | 2/1966 | Conner | 297/357 X |
| 3,516,710 | 6/1970 | Sherbert et al. | 297/357 X |
| 3,594,040 | 7/1971 | Monroe | 297/357 X |

FOREIGN PATENT DOCUMENTS

| | | | |
|---|---|---|---|
| 820,247 | 9/1951 | Germany | 297/357 |

*Primary Examiner*—Roy D. Frazier
*Assistant Examiner*—William E. Lyddane
*Attorney, Agent, or Firm*—Glenn H. Antrim

[57] ABSTRACT

A first separable pivot is at the height of the pelvis of an occupant and has a guide for supporting a back rest while the support thereof is being transferred from the first separable pivot to a second separable pivot near the bottom of the back rest. A pin secured to the back rest is positioned in a toothed slot for different positions of tilt while the first pivot is engaged and during folding is positioned in an adjusting arcuate slot for maintaining the second pivot engaged.

5 Claims, 3 Drawing Figures

SEAT HAVING BACK REST WITH DIFFERENT PIVOTS FOR TILTING AND FOR FOLDING LEVEL

BACKGROUND OF THE INVENTION

This invention relates to seat assemblies with pivotally mounted back rests and particularly to seat assemblies that have different pivots at different heights for supporting back rests.

In certain types of vehicles in which the seat assemblies are used, the back rests must be folded compactly over the seat cushions to allow access to adjacent equipments. Seat assemblies may have their back rests supported on only one pair of pivots on a single axis of rotation for tilting the back rests and for folding the back rests over their seat cushions. Locking means connected to the back rests provide different degrees of adjustable tilt to suit the occupants of the seat assemblies.

To obtain maximum comfort at various degrees of tilt, the transverse axis about which a back rest of a seat assembly is to be rotated for tilt should be approximately at the height of the pelvis of an occupant of the seat assembly such that for different degrees of tilt, the distance from that portion of the back rest adjacent the pelvis to the upper front edge of the seat cushion remains constant. However, if the back rest were to be folded on pivots at this height, the seat assembly would not be folded as compactly as desired because the entire back rest would be positioned horizontally at a level above the seat cushion, and the edge of the back rest that is normally the lower edge would extend back of the seat cushion.

SUMMARY OF THE INVENTION

A seat assembly according to the present invention has one pair of pivotal supports on a transverse axis of the back rest at about the height of the pelvis of an occupant, and another pair of pivotal supports at the level of the lower edge of the back rest for folding the back rest compactly over the seat cushion. At each side of the seat assembly, means for locking the back rest in different degrees of tilt is provided by a rigid pin that can be positioned in different toothed portions of a slot, and additionally when the back rest is being folded, the pin is positioned within an arcuate slot that joins the toothed slot. While the pin is in the arcuate slot, it supports and guides the back rest as the pivotal axis is transferred from one of the pivotal supports to the other, and holds the lower pivotal support together while the back rest is folded forwardly to a position over the seat cushion.

DESCRIPTION OF THE PREFERRED EMBODIMENT

Figure 1:
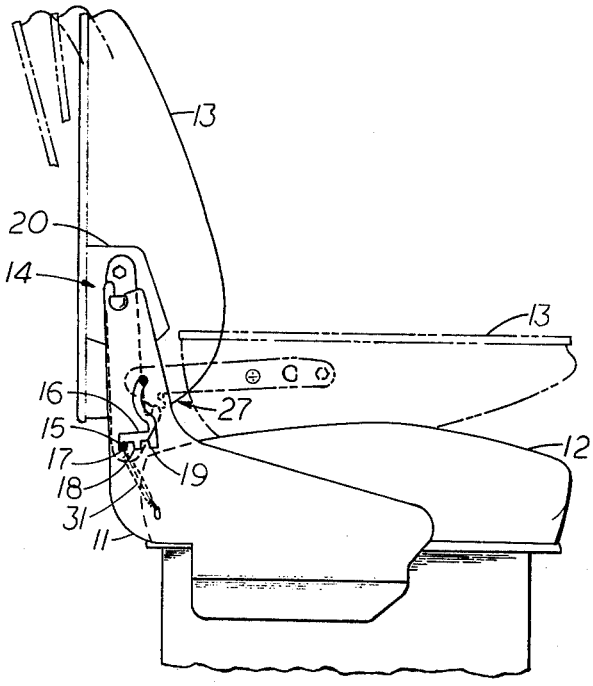
FIG. 1 is a side view of a seat assembly of the present invention to show in dashed lines positions for tilting and folding the back rest.

FIG. 1 shows one side of a rigid seat frame, the frame supporting a seat cushion 12 in a usual manner and supporting a back rest 13 through the use of two pairs of pivots according to this invention. The seat frame 11 includes in a usual arrangement a similar side that is connected by usual rigid cross members to the side that is shown. Usual suspensions for the seat assembly and the lower portions of the frame 11 for securing the seat assembly to a floor are omitted in the drawing.

While the seat assembly is in normal use and the back rest 13 is adjusted for a desired degree of tilt, the back rest is supported by an upper separable pivot 14 and is retained in a desired tilt by a pin 15. The pin 15 is firmly fixed to the back rest 13 and extends through a horizontal slot 16 within an upwardly extending portion of the seat frame 11, the pin 15 and the slot 16 defining locking means retaining the back rest in the desired tilt. The slot 16 has three downwardly extending notches 17–19 for determining the degree of tilt. When the back rest 13 is substantially upright, the pin 15 is positioned in the rear notch 17; when the back rest 13 is in an intermediate position shown in dashed lines, the pin 15 is positioned in the intermediate notch 18; and when the back rest 13 is inclined farthest back as shown in dashed lines, the pin 15 is in the front notch 19. The tilt of the back rest 13 is changed by lifting it upwardly slightly, rotating it about the pivot 14 until the pin 15 is over a notch 17–19 that corresponds to the desired tilt, and lowering the back rest. Except when the pin 15 at each side of the back rest is positioned over the respective notch 19 as described below, the pin 15 contacts the upper edge of the respective slot 16 to function as a stop before the upper pivot 14 becomes separated as the back rest 13 is lifted.

Figure 2:
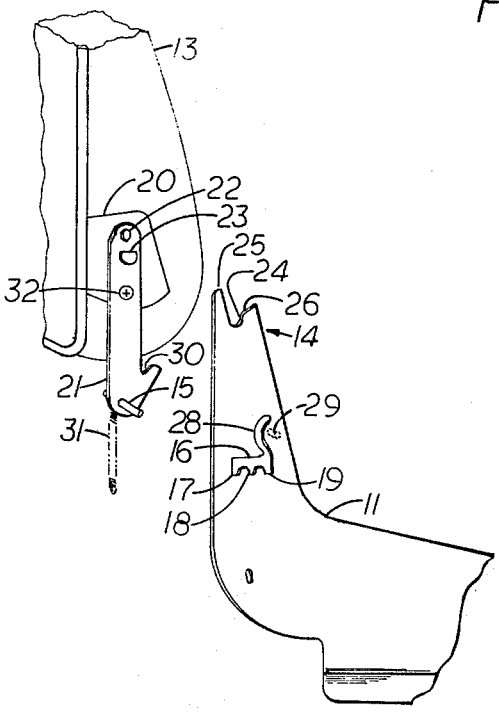
FIG. 2 is an exploded view of separable pivotal supports at one side of a seat assembly including a supporting plate of a seat cushion and an adjacent portion of a seat frame.

For securing the pin 15 and a portion of the pivot 14 rigidly to the back rest 13, a corner plate 20 as shown in FIG. 2 is fastened to the usual rigid frame of the back rest 11 such that a portion of the plate 20 extends along the side of the back rest 13 at about the level of the pelvis of an occupant of the seat. Except for holes required for attachment of pivotal members, the plate may be covered with the upholstery material of the back rest 13. The plate 20 is a rigid mounting surface for a downwardly extending, elongated plate or member 21 that is fastened to the plate 20 by machine screws 22 and 32. An outwardly extending shoulder stud is welded to the member 21, and the outer shank of the stud functions as the journal of the pivot 14. The pin 15 extends perpendicularly through the lower end of the plate 21. The shank of the shoulder stud 23 normally fits in a arcuate notch 24 that is within the upper end of the upwardly extending side of the seat frame 11. The notch 24 is open in an upward direction, and a projection 25 back of the notch extends upwardly far enough to prevent the stud 23 from being moved rearwardly while the back rest 13 is pulled upwardly for changing the degree of tilt. A guiding edge 26 of the frame 11 extends forwardly from the notch 24 to the front edge of the upwardly extending side of the frame 11, and it is at a suitable height with respect to the bottom of the notch 24 and the location of the pin 15 to allow the back rest 13 to be tilted forwardly as described below. The shoulder stud 23 has a head that overlaps the adjacent outer surface where it is positioned on the frame 11.

Figure 3:
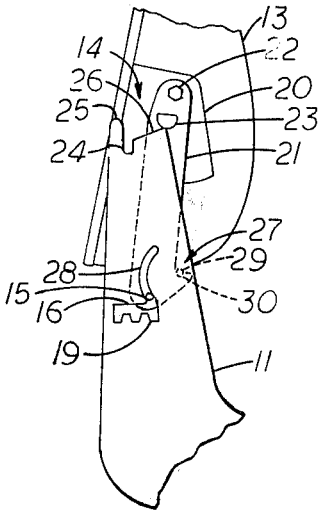
FIG. 3 is a side view of the supporting plate and the portion of the seat frame to show the transfer of the support of the back rest from an upper pivotal support to a lower pivotal support.

With reference to FIG. 3, while the back rest 13 is being rotated forwardly over the seat cushion 12, the back rest is rotated about a second separable pivot 27 at each side of the seat assembly while the respective pin 15 is guided by an arcuate slot 28, said pin 15 and said slot 28 cooperating to define guiding means for maintaining the pivot 27 together. The pivot 27 comprises a pintle 29 and an arcuate bearing 30. The pintle 29 extends inwardly from the frame 11 at the radial center of the arcuate slot 28. The front edge of the plate 21 at its lower end is shaped somewhat like a hook to form the arcuate bearing 30. To join the parts of the pivot 27, the plate 21 is moved upwardly and forwardly with the back rest 13 such that its arcuate bearing 30 is positioned about the pintle 29. To provide continuous support for the back rest 13 as its axis of rotation is being transferred from a transverse axis through shoulder stud 23 to a transverse axis through pintles 29, the relative locations of the pin 15, the guiding edge 26, the arcuate slot 28, and the arcuate bearing 30 must be chosen carefully. To fold the back rest 13 over the seat cushion 12, the back rest must first be tilted backwardly until the pin 15 is over the notch 19 of the horizontal slot 16. The back rest is then pulled upwardly to move the pin 15 into the arcuate slot 28. The vertical distance between the horizontal slot 16 and the arcuate slot 28 must be just sufficient to permit the shoulder stud 23 to be raised out of the arcuate notch 24 and to be moved forwardly over the guiding edge 26 as the pin 15 enters the arcuate portion of the slot 28. Before the stud 23 is brought forwardly far enough over the guiding edge 26 to clear the frame 11, the pin 15 must have entered far enough into the lower portion of the arcuate slot 28 to prevent the back rest 13 from falling while the pin 15 bears radially outwardly for support on the edge of the slot 28. The guiding edge 26 and the slot 28 guides the back rest 13 and its attached plate 21 such that the arcuate bearing 30 is positioned about the pintle 29 before the stud 23 leaves the guiding edge 26. As the upper portion of the back rest 13 continues to be brought forwardly, the pin 15 follows in the arcuate slot 28 to maintain the arcuate bearing 30 closely about the pintle 29.

As shown in FIGS. 1 and 2, to apply a downward force in addition to that supplied by the weight of the back rest 13, a tension spring 31 is connected from the inner end of the pin 15 at each side of the seat assembly to the frame 11 at a position below the pin. The tension of the springs 31 helps maintain the back rest 13 in a selected position of tilt and helps to rotate the back rest 13 from a folded position to an upright position. While the back rest 13 is folded, a slight upward push on the portion of the back rest that is over the front of the seat cushion 12 will cause the back rest to flip into its upright position.

We claim:

1. In a seat assembly having a rigid seat frame, a seat cushion and a back rest supported by said frame, a first separable pivot connecting said back rest to said seat frame, said first separable pivot being on that transverse axis of said back rest about which said back rest is to be rotated for adjustment of tilt, locking means spaced from said first pivot and connecting said back rest and said seat frame in different selected degrees of tilt of said back rest, a second separable pivot on a different transverse axis of said back rest, said second separable pivot connecting said back rest to said seat frame during rotation of said back rest to a folded position over said seat cushion, said first separable pivot comprising a stud and a first arcuate bearing connected individually to said back rest and said seat frame, said first arcuate bearing being open in an upwardly direction, a guiding edge extending from an upper portion of said first arcuate bearing in a substantially horizontal direction such that said bolt is movable thereover for supporting said back rest until said bolt is free while said back rest is lifted slightly upwardly and then the upper portion of said back rest is tilted forwardly, said second pivot comprising a pintle and a second arcuate bearing connected individually to said back rest and said seat frame, said second pivot being separated while said back rest is in position for use, guiding means connecting said back rest to said seat frame, said guiding means cooperating with said guiding edge to position said pintle within said second arcuate bearing surface as said stud is removed from said first arcuate bearing and moved along said guiding edge, and said guiding means maintaining said pintle within said second arcuate bearing while said back rest is rotated to said folded position around said different transverse axis.

2. In a seat assembly, first and second separable pivots as claimed in claim 1 wherein said locking means comprises a rigid plate positioned flat along a side of said back rest, said first arcuate bearing being on a portion of said frame extending upwardly adjacent the outer surface of said rigid plate, said portion of said frame having spaced from said first arcuate bearing a horizontal slot with spaced downwardly directed tooth-shaped portions, a rigid pin extending outwardly from said rigid plate and passing into said horizontal slot while said stud is positioned within said first arcuate bearing, and said pin being movable to different tooth-shaped portions of said slot by moving said back rest vertically and rotating said back rest to said different selected degrees of tilt.

3. In a seat assembly, first and second pivots as claimed in claim 2 wherein said second arcuate bearing is contained in the front edge of said rigid plate, and said pintle extends inwardly from said portion of said seat frame.

4. In a seat assembly, first and second pivots as claimed in claim 3 wherein said guiding means comprises an arcuate slot within said portion of said seat frame, the radial center of said arc being on the axis of said pintle, said arcuate slot extending upwardly from said horizontal slot, and said rigid pin being guided in said arcuate slot while said back rest is being folded.

5. In a seat assembly, first and second pivots as claimed in claim 4 wherein tension spring means is connected from a point on said seat frame below said separable pivotal supports to a point on said back rest normally below said second pivotal support for urging said back rest upright and for applying a downward force thereto.

* * * * *